United States Patent [19]

Bethurum

[11] 4,120,425

[45] Oct. 17, 1978

[54] APPARATUS FOR DISPENSING SPARKLING WINES

[75] Inventor: George M. Bethurum, Pasadena, Tex.

[73] Assignee: The Champagne Machine Inc., Pasadena, Tex.

[21] Appl. No.: 699,955

[22] Filed: Jun. 25, 1976

Related U.S. Application Data

[63] Continuation of Ser. No. 285,563, Sep. 1, 1972, abandoned.

[51] Int. Cl.[2] ..... B67D 5/62

[52] U.S. Cl. ..... 222/146 C; 222/386.5

[58] Field of Search ..... 222/386.5, 146, 94, 222/96, 146 C

[56] References Cited

U.S. PATENT DOCUMENTS

| | | | |
|---|---|---|---|
| 1,977,862 | 10/1934 | Scholtes | 222/386.5 |
| 2,792,692 | 5/1957 | Bryan | 222/146 C |

*Primary Examiner*—Stanley H. Tollberg

[57] ABSTRACT

A technique is provided for dispensing champagne and the like which is neither flat nor frothy. The system includes a sparkling wine storage vessel having a flexible diaphragm for pneumatic pressurization without gas coming in contact with the wine. A metering valve on the vessel limits flow of wine into a very long small diameter tube having a flow cross-section greater than the flow cross-section through the valve. An ordinary on-off valve at the other end of the tube dispenses the sparkling wine. The tube is sufficiently long and small enough in diameter that viscous drag gradually drops pressure on the wine and inhibits excessive bubble formation.

2 Claims, 1 Drawing Figure

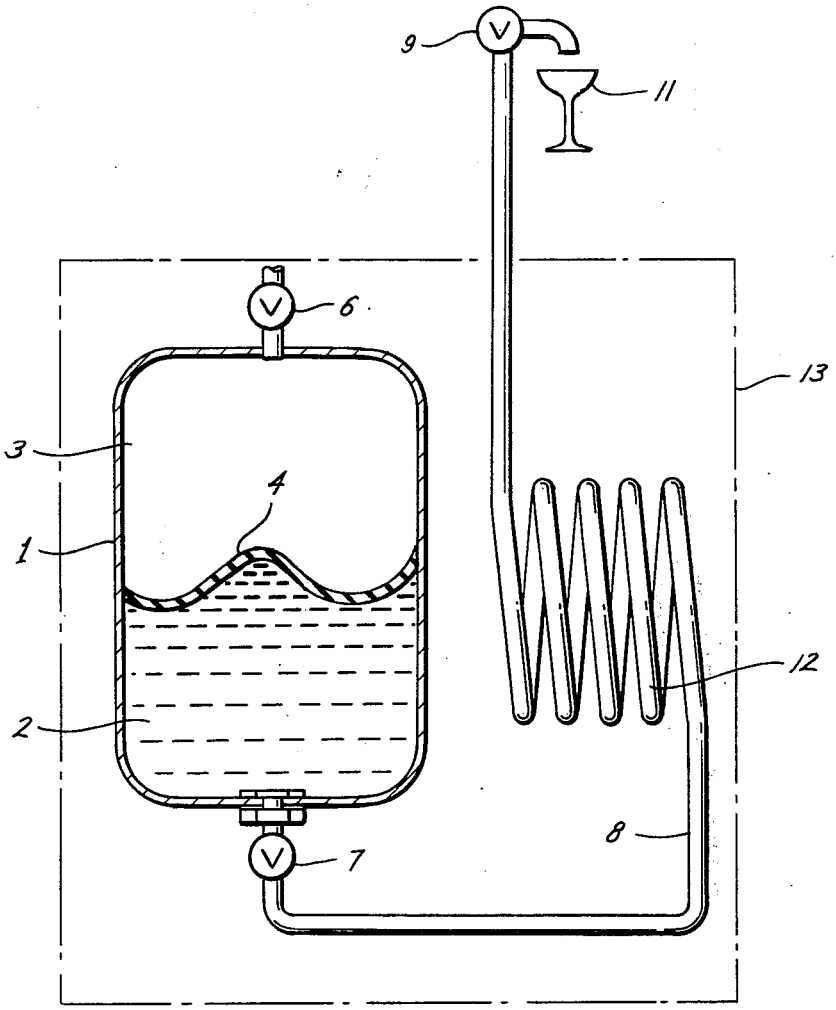
9
11
6
13
3
4
1
12
2
8
7

APPARATUS FOR DISPENSING SPARKLING WINES

CROSS-REFERENCE TO RELATED APPLICATION

This is a continuation of application Ser. No. 285,563, filed Sept. 1, 1972 now abandoned under 35 U.S.C. 120 for benefit of its filing date.

BACKGROUND OF THE INVENTION

Carbonated and similar effervescent beverages, such as beer, have been dispensed from pressurized containers for a number of years. Such systems apply a gas pressure, which typically is carbon dioxide, over the beverage to maintain effervescence and force the beverage through a dispensing spigot. In beer, for example, the formation of a frothy head is considered desirable. The same is not true of champagne and other sparkling wines, such as sparkling burgundy, cold duck and the like. There has not been a successful technique for dispensing champagne by the glass without the remainder of the champagne going flat or excessive formation of bubbles and froth in the glass.

Because there has not been a satisfactory technique for dispensing champagne by the glass, it has been necessary for the consumer to purchase an entire bottle which must be used relatively promptly after it is opened. The smallest bottle that can be purchased is a so-called "split," or 1/20 of a gallon. Because of the cost of handling the small bottles of champagne, a very high retail price has been required. Many times it is desirable to serve a single glass of champagne or provide champagne for an individual cocktail. It also serves as a topping for other beverages.

There are a number of technical problems involved in dispensing champagne or other sparkling wine by the glass without the champagne going flat or the formation of excessive foam. Government regulations prohibit the introduction of any gas into champagne after it leaves the winery, thus techniques for dispensing beer or the like are not suitable for sparkling wines. Champagne is preferably served at an temperature of about 35° F. and extreme chilling is therefore desirable. Pressure must be maintained on the sparkling wine at all times in order to keep it from going flat. If the champagne is dispensed from such a high pressure system, the sudden release of pressure results in heavy frothing in the glass.

In the ordinary bottling of champagne the bottles are filled at a temperature of from about 18° to 22° F. and at an elevated pressure. The pressure in the bottles is incrementally reduced to atmospheric pressure and the bottle is sealed with a small ullage over the wine to accommodate the pressure changes that are a consequence of varying temperatures to which the wine may be exposed before it is opened and used. As is well-known, once a bottle of champagne is opened, it must be completely used in a relatively short period or its sparkle is lost. Because of this the techniques for handling bottled champagne are not suitable for handling champagne that is stored in relatively large quantities and dispensed by the glass.

It is, therefore, desirable to provide a technique for dispensing champagne by the glass or in similar small quantities without the balance of the champagne or other sparkling wine going flat in the container and without production of excessive froth in the glass.

SUMMARY OF THE INVENTION

Thus, in practice of this invention according to a presently preferred embodiment, sparkling wines are dispensed from a storage vessel pressurized with an innner flexible diaphragm preventing contact between the wine and a pressurized gas. A metering valve admits wine from the vessel into a very long, small diameter tube through which it flows to an on-off valve for dispensing. The tube is sufficiently long and has a sufficiently small diameter that formation of bubbles is inhibited.

BRIEF DESCRIPTION OF THE DRAWING

These and other features and advantages of the present invention will be appreciated as the same becomes better understood by reference to the following detailed description of a presently preferred embodiment when considered in connection with the accompanying drawing which comprises a schematic illustration of a sparkling wine dispensing system constructed according to principles of this invention.

DESCRIPTION OF THE PREFERRED EMBODIMENT

The drawing illustrates schematically a system for dispensing champagne by the glass or in similar small quantities. As illustrated in this presently preferred embodiment, there is a pressure-resistant tank 1 typically made of steel. The interior of the tank is divided into a liquid chamber 2 and a gas chamber 3 by a flexible diaphragm 4. A valve 6 communicates with the gas chamber 3 so that pressure within the tank can be regulated by adding or subtracting gas as required. A throttling needle valve 7 communicates with the liquid chamber 2 of the tank. The tank is what is commonly known as a pressure accumulator and such accumulators are commonly used in hydraulic systems. In practice of this invention, a suitable accumulator is available from American Tube Controls under their trade designation Well-X-Trol. The ordinary accumulator is commonly used in contact with hydraulic fluid, water, or the like, rather than champagne or other sparkling wine. Therefore, the materials of construction are sometimes not suitable. It is, therefore, desirable to line the liquid chamber 2 with polypropylene or similar material that is substantially inert to the wine. It has been found that butyl rubber forms a satisfactory flexible diaphragm 4.

When the tank is filled at the winery, champagne or other sparkling wine is forced into the liquid chamber 2 under pressure, typically about 150 psi. When the tank is empty, the bladder or diaphragm 4 conforms to the end of the tank so that substantially the entire interior of the tank is filled with gas and the liquid chamber 2 virtually disappears. On the other hand, when the liquid chamber is filled, the flexible diaphragm extends towards the opposite end of the tank, but not the complete distance. Typically, when the tank is filled, the liquid chamber 2 occupies about two-thirds of its volume and the gas chamber 3 occupies about one-third. In a typical embodiment, about three gallons of wine is put into the liquid chamber at the winery and the pressure in the gas chamber 3 is set at about 150 psi before the valve 6 is closed. In use of the champagne dispensing system the valve 6 remains closed and the pressure in the gas chamber acting on the diaphragm is available for expelling the champagne from the tank. By use of a flexible diaphragm in the tank, the gas is kept out of contact with the wine as required by Government regulations. For this reason, any convenient gas can be used for pressurizing the gas chamber. Typically nitrogen is used as it is readily available in a dry form.

A polyethylene tube 8 is connected to the needle valve 7 and communicates in turn to a conventional on-off valve or spigot 9. The spigot opens to an extent larger than the flow cross-section of the tube 8. Champagne or other sparkling wine dispensed from the system passes through the spigot 9 to a conventional champagne glass 11, or the like.

The plastic tube 8 is an important element of the combination and serves as more than a mere conduit between the needle valve 7 and the spigot 9. In a preferred embodiment, the plastic tube is conventional polyethylene with a smooth interior bore. The tubing is nominally about ¼ inch outside diameter with a wall thickness of about 0.06 inch so that the approximate inside diameter of the tube is ⅛ inch. In such an embodiment, the total length of the small diameter tubing is about 30 feet so that the length to diameter ratio of the tube is about 240:1. Because there is a substantial length of tubing, it is wrapped in a coil 12 which typically has an inside diameter of a little less than about 6 inches and an outside diameter of about eight inches. In a commercial embodiment of such a champagne dispensing system, four tanks of sparkling wine may be available and four such tubes may be wrapped together in the same coil 12. Surprisingly, it is found that the coiling of the long tube is helpful in obtaining proper dispensing of the champagne. Thus, for some unknown reason, a coil with an average diameter of about 7 inches gives better dispensing than either a larger or smaller diameter coil of the ⅛ inch I.D. tubing.

Since the optimum temperature for serving champagne is about 35° F., the tank and long tube, including the coil 12, are container in a conventional refrigerator 13, shown schematically in phantom in the drawing. Only the spigot 9 and such short amount of tubing as is necessary to reach the spigot is outside the refrigerated compartment. The refrigerator provides means for maintaining the tank and elongated tube including the coil 12 at a temperature of less than about 32° F. Preferably, the temperature of the wine in the refrigerator is maintained in the range of from about 20° F.–24° F. If the temperature is below this range, some formation of slush may occur as pressure is relieved. The wine temperature is preferably substantially below the optimum serving temperature since the glasses used for serving the champagne are typically at room temperature. It has been found that the wine may warm about 10° F. while chilling a typical champagne glass. Thus, if the wine is stored and dispensed at a temperature higher than about 24° F., it may reach the consumer at a temperature above the optimum serving temperature. The wine may be stored and dispensed at temperatures as high as about 32° F. if the glasses are pre-chilled.

The combination of the throttling needle valve 7 adjacent the wine storage tank and the long small diameter tube 8 leading to the on-off spigot 9 permits the dispensing of the sparkling wine with considerably effervescence and without frothing. This result is obtained in the method of dispensing of sparkling wine by opening the on-off spigot 9 and then adjusting the needle valve 7 until the champagne flows from the spigot at about the same velocity as it is poured from a bottle. Thus, although the pressure in the tank may be as high as about 150 psi, the pressure at the spigot is little more than ambient pressure and there is no sudden decrease in pressure at this point to induce heavy formation of bubbles.

The flow orifice through the needle valve when so adjusted is small as compared with the flow cross-section of the tube 8. Thus, it is believed that a principal portion of the pressure drop between the tank and the spigot occurs across the throttling orifice of the needle valve. Additional in line pressure drop occurs gradually along the length of the long small tube 8 due to viscous drag of the moving fluid. Since the pressure drop occurs gradually along the length of the tube and substantially entirely within the refrigerated cabinet, there is little, if any, tendency to form bubbles within the tube. It appears that the resistance to formation of bubbles is sufficient that even if bubbles do occur, they collapse and the gas therein redissolves in the wine. It has been observed that bubbles will sometimes form in the sparkling wine at the throttling valve but that such bubbles do not progress a substantial distance along the tube and apparently they redissolve. This effect can be observed since the preferred polyethylene tubing is translucent.

As the wine stored in the tank is depleted, the gas volume 3 decreases and there is a concomitant reduction in pressure within the tank. As the last of the wine is discharged, the pressure may have decayed to about 45 to 50 psi. Since the driving pressure is dropping, it is occasionally found that it is desirable to adjust the needle valve 7 to maintain an adequate flow rate through the spigot without excess frothing. It is important that the pressure in the tank remain above about 40 psi to keep the wine from going flat.

When the on-off spigot is closed, the pressure on the sparkling wine in the tube 8 remains at the pressure of the gas in the tank since the needle valve remains open. When the spigot is opened, the first spurt of wine is commonly bubbly because of the sudden release of pressure. Thereafter the wine flowing through the tube and coil flow slowly and uniformly and is not excessively bubbly. This is believed to be due to the principal pressure drop at the needle valve 7 with additional pressure drop through the tube 8 and coil 12. One reason that the coil 12 may be effective in assuring proper sparkling wine dispensing may lie in the constant but gradual change in direction of the wine as it flows. It may be that laminar flow occurs in the elongated tube and the curvature introduced by the coil causes sufficient boundary layer drag to increase the pressure drop in the tube. This pressure drop would occur gradually and, hence, would not induce formation of bubbles in the tube.

Although one embodiment of technique for dispensing wine by the glass has been described and illustrated herein, many modifications and variations will be apparent to one skilled in the art. Thus, for example, the specific configuration of the elongated tube between the metering valve and the on-off spigot may be varied while still maintaining a gradual pressure drop to eliminate foaming. Thus, longer, larger diameter tubes may be used if desired for in line depressurization, or, if it is desired to increase the rate of champagne dispensing, parallel long small diameter tubes may be used. It is, therefore, to be understood that within the scope of the appended claims the invention may be practiced otherwise than as specifically described.

I claim:

1. An apparatus for dispensing sparkling wine without foaming or going flat, comprising;

a storage vessel including an inert flexible diaphragm subdividing vessel into a gas containing portion and a sparkling wine containing portion, said portions being inversely variable in volume;

a throttling orifice having its inlet connected to the vessel in the liquid containing portion;

an elongated tube connected to the outlet of the throttling orifice, said tube being sufficiently long that the gradual pressure drop as wine flow therethrough prevents frothing of the wine, the flow cross-section of the tube being greater than the flow cross-section through the throttling orifice;

an on-off valve on the end of the tube where the sparkling wine is dispensed; and wherein the elongated tube has an inside diameter of about ⅛ inch and a length of about 30 feet; and is curled into a coil for a major portion of its length between the throttling orifice and the on-off valve.

2. An apparatus for dispensing sparkling wine as defined in claim 1 wherein the storage vessel is lined with polypropylene and the flexible diaphragm is formed of butyl rubber.

* * * * *